United States Patent [19]

Collinsworth

[11] Patent Number: 5,058,689

[45] Date of Patent: Oct. 22, 1991

[54] WEAR PROTECTIVE MEANS FOR A DRILLING TOOL

[76] Inventor: Stephen M. Collinsworth, P.O. Box 358, Stanton, Ky. 40380

[21] Appl. No.: 599,721

[22] Filed: Oct. 19, 1990

[51] Int. Cl.[5] ..... E21B 17/10

[52] U.S. Cl. ..... 175/325; 175/408

[58] Field of Search ..... 175/325, 344, 406, 408; 166/241

[56] References Cited

U.S. PATENT DOCUMENTS

| | | | |
|---|---|---|---|
| 2,022,101 | 11/1935 | Wright | 175/408 |
| 2,210,824 | 8/1940 | Walker, Sr. | 175/408 |
| 2,562,346 | 7/1951 | Whittaker | 175/406 |
| 2,715,552 | 8/1955 | Lane | 175/325 |
| 3,181,632 | 5/1965 | Raynal | 175/408 |
| 3,825,081 | 7/1974 | McMahon | 175/325 |
| 3,833,077 | 9/1974 | Lavallee | 175/408 |
| 3,945,446 | 3/1976 | Ostertag et al. | 175/325 |
| 3,978,933 | 9/1976 | Olson et al. | 175/325 |
| 4,011,918 | 3/1977 | Jurgens | 175/325 |
| 4,106,823 | 8/1978 | Bassinger | 175/325 |
| 4,231,437 | 11/1980 | Swersky et al. | 175/408 |
| 4,245,709 | 1/1981 | Manuel | 175/325 |
| 4,258,804 | 3/1981 | Richey et al. | 175/325 |
| 4,549,613 | 10/1985 | Case | 166/241 |

*Primary Examiner*—Bruce M. Kisliuk

*Attorney, Agent, or Firm*—Frank C. Leach, Jr.

[57] ABSTRACT

A drill bit sub, which has a drill bit with three equally angularly spaced cutters releasably threaded into its bottom surface, has its lower portion reduced in diameter. A protective sleeve, which is a hollow cylindrical metal tube, is releasably attached to the lower portion of the drill bit sub so that three equally angularly spaced lugs are at specific circumferential positions relative to the cutters. The lugs engage three equally angularly spaced wear strips on a wear strip support, which is mounted on the lower portion of the drill bit sub below the protective sleeve, so that the wear strip support rotates with the drill bit sub. The drill bit bears against the lower end of the wear strip support when the drill bit is mounted on the drill bit sub. The specific positions of the lugs on the protective sleeve align each of the three wear strips with the maximum outer protrusion of one of the three cutters on the drill bit. A break out ring may be mounted on the lower portion of the drill bit sub above the protective sleeve. The lower portion of the drill bit sub may have air passages extending from its outer surface to an axial passage through which compressed air passes so that dust cannot build up between the lower portion of the drill bit sub and each of the protective sleeve and the wear strip support.

18 Claims, 3 Drawing Sheets

WEAR PROTECTIVE MEANS FOR A DRILLING TOOL

This invention relates to wear protective means for a drilling tool and, more particularly, to removable wear protective means for a drilling tool.

When drilling a hole into the ground with a drilling tool, the drilling tool has stabilizing means in its lower end to guide the drill bit on the end of the drilling tool so that a straight hole is drilled. Examples of such stabilizing means are disclosed in U.S. Pat. Nos. 2,022,101 to Wright, 2,210,824 to Walker, Sr., 3,181,632 to Raynal, 4,106,823 to Bassinger, 4,231,437 to Swersky et al, 4,245,709 to Manuel, and 4,258,804 to Richey et al.

It also has been previously suggested to weld wear strips, which function as stabilizing means, on the lower portion of a drill bit sub, which has a drill bit with cutters threaded into its bottom end. This arrangement has been used in drilling blasting holes in which explosives are placed in a plurality of holes to provide access to coal for strip mining, for example.

When forming such holes, pressurized air is supplied through a longitudinal passage extending from a source of pressurized air on the ground through the interior of the drilling tool and exiting at the bottom of the hole. This pressurized air bounces off the side of the hole near its bottom and hits the area of the drill bit sub near the wear strips. Since the pressurized air picks up particles produced by the cutters, these particles strike the drill bit sub with sufficient force to create a sand blast effect thereon. Accordingly, the drill bit sub is worn over a period of time by this sand blast effect.

If the operator fails to replace the worn drill bit sub during one of the times when the drill bit has been raised from the hole to above the ground, the drill bit sub can fail while in the hole. As a result, there would be a loss of the drill bit with its expensive cutters at the bottom of the hole. Even if the drill bit can be retrieved, it is not inexpensive to accomplish this and production of further holes is stopped until the drill bit is retrieved.

In addition to the drill bit sub failing by metal fatigue, the wear strips also can fail, and this usually occurs earlier than failure of the drill bit sub. The failure of the wear strips requires removal of the failed wear strips and welding of new wear strips on the drill bit sub after withdrawing the drilling tool from the hole. This also increases the cost. For example, the production downtime plus the welding cost results in a cost of about $235 to replace the three wear strips on a drill bit sub. Replacement of a drill bit sub without any wear strips thereon is about $350.

If a new drill bit sub is required, wear strips, which are equal to the number of the cutters on the drill bit, must be welded to the new drill bit sub at specific locations relative to the location of the maximum outer protrusion of each of the cutters on the drill bit. Each of the wear strips must be specifically located relative to one of the cutters because each of the cutters has a relief area, which is not at the maximum outer protrusion of the cutter, to enable upward advancement of the removed material past the cutter.

The wear strips not only stabilize the lower end of the drilling tool but also aid in directing the removed material upwardly. The wear strips further aid in quicker removal of the drilling tool out of the hole when desired.

The present invention satisfactorily overcomes the problems of the drill bit sub inadvertently failing and the downtime required for replacing the wear strips. This is accomplished through reducing the diameter of the lower portion of the drill bit sub and disposing removably mounted means on the reduced lower portion of the drill bit sub. The removably mounted means includes at least a wear strip support having wear strips mounted thereon. The drill bit, which is threaded to the bottom of the drill bit sub, bears against the bottom of the wear strip support, which extends slightly beyond the reduced lower portion of the drill bit sub.

The removably mounted means also may include a removably mounted protective sleeve between the wear strip support and a shoulder formed at the junction of the upper and lower portions of the drill bit sub. The removably mounted means also may include a break out ring between the shoulder of the drill bit sub and the top of the protective sleeve.

Since the wear strips must rotate with the drill bit sub and each of the wear strips must be aligned with the maximum outer protrusion of one of the cutters on the drill bit, when the protective sleeve is used, it must be specifically oriented on the drill bit sub. The protective sleeve has equally angularly spaced driving lugs equal to the number of wear strips with the number of the wear strips equal to the number of the cutters on the drill bit. Each of the driving lugs engages one of the wear strips during rotation of the drill bit sub so that the wear strips rotate with the drill bit sub along with being precisely located relative to the maximum outer protrusion of the cutters on the drill bit at least during rotation.

The protective sleeve is precisely oriented through positioning an attaching hole in the reduced lower portion of the drill bit sub relative to the driving lugs so that each of the lugs on the protective sleeve will engage one of the wear strips on the wear strip support to align each of the wear strips with the maximum outer protrusion of one of the cutters of the drill bit at least during rotation.

To aid in removing the drill bit from its threaded attachment to the drill bit sub, the break out ring is preferably employed. The break out ring has at least one weakened portion, which is fractured by a tool such as a chisel, for example, when it is desired to remove the drill bit. This removal of the break out ring enables the protective sleeve and the wear strip support to be lifted slightly whereby there is no binding of any surface of the drill bit with the bottom of the wear strip support.

Instead of using the protective sleeve and the wear strip support as separate elements with or without the break out ring, the wear strip support can extend for the length of the protective sleeve and the wear strip support. In this arrangement, the wear strip support is driven through suitable means on the drill bit. It is preferred to have a break out ring with at least one weakened portion between the shoulder on the drill bit sub and the top of the wear strip support.

With any of these arrangements, the wear strip support can be easily removed at selected use intervals so that failure of the wear strips will not occur. For example, the wear strip support could be removed each time that the drill bit is replaced. This usually is at a minimum of 15,000 feet of drilling by the drill bit cutters.

When no break out ring is employed, the protective sleeve could be removed at a selected us interval greater than that when the wear strip support is replaced. For example, the protective sleeve could be removed with every third replacement of the drill bit; this would be at least 45,000 feet of drilling by the drill bit cutters.

An object of this invention is to provide wear protective means for a drilling tool.

Another object of this invention is to provide removable wear protective means for a drilling tool.

Other objects of this invention will be readily perceived from the following description, claims, and drawings.

This invention relates to a drilling tool for drilling a hole in the ground including a drill bit sub having a lower reduced portion with removably mounted means removably mounted thereon. The removably mounted means has a plurality of wear strips thereon. A drill bit, which has a plurality of cutters, is releasably attached to the bottom of the drill bit sub for rotation therewith with the drill bit being adjacent the removably mounted means and engaging the bottom of the removably mounted means. Causing means causes rotation of the removably mounted means with the drill bit sub and the drill bit. Each of the wear strips on the removably mounted means is aligned with one of the cutters on the drill bit at least during rotation of the drill bit sub.

This invention also relates to a protective sleeve for use with a drill bit sub of a drilling tool having a drill bit with cutters for drilling a hole in the ground and for transmitting rotation of the drill bit sub to a wear strip support having a plurality of equally angularly spaced wear strips extending from its outer surface. The protective sleeve includes a hollow cylindrical tube having a plurality of equally angularly spaced engaging means thereon with each of the engaging means engaging one of the wear strips on the wear strip support. Positioning means positions the hollow cylindrical tube on the drill bit sub at a predetermined position so that each of the wear strips on the wear strip support engaged by one of the engaging means will be aligned with the maximum outer protrusion of one of a plurality of cutters on the drill bit releasably attached to the bottom end of the drill bit sub when each of the engaging means engages one of the wear strips.

The attached drawings illustrate preferred embodiments of the invention, in which.

Figure 1:
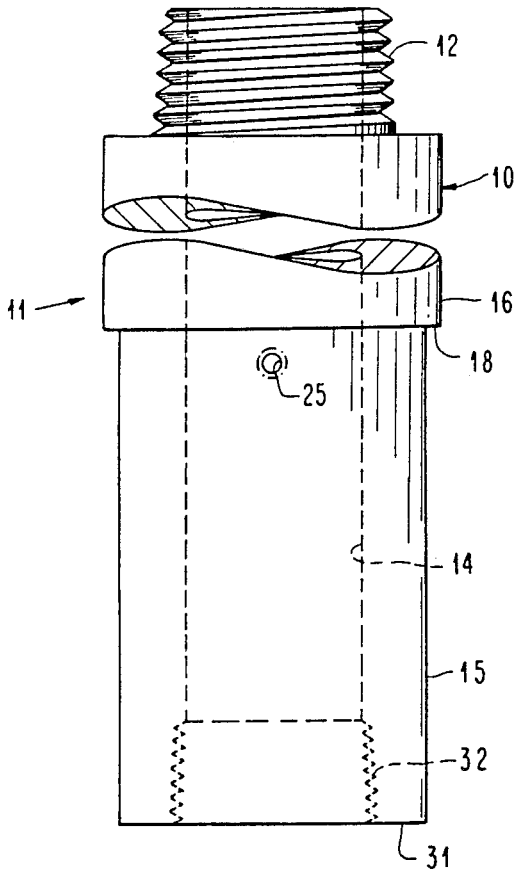
FIG. 1 is an elevational view of a drill bit sub of the present invention.

Referring to the drawings and particularly FIG. 1, there is shown a drill bit sub 10 of a drilling tool 11 for drilling a hole in the ground. The drill bit sub 10 is connected to a lowermost drill section (not shown) of the drilling tool 11 through having its threaded upper end 12 threaded into a threaded receptacle (not shown) in the drill section (not shown) of the drilling tool 11.

The drilling tool 11 has driving means on the ground at the upper end of the drilling tool 11 for rotating the drill bit sub 10 in the well-known manner. Pressurized air is supplied from a pressurized air source (not shown) on the ground through communicating longitudinal or axial passages in the drilling section of the drill tool 11 to a longitudinal or axial passage 14 extending through the drill bit sub 10.

The drill bit sub 10 has a lower portion 15 formed with a reduced diameter. The diameter of the lower portion 15 is $\frac{1}{2}''$ smaller than the diameter of an upper portion 16 of the drill bit sub 10. For example, if the upper portion 16 has a diameter of $5\frac{1}{2}''$, then the lower portion 15 has a diameter of 5".

Figure 4:
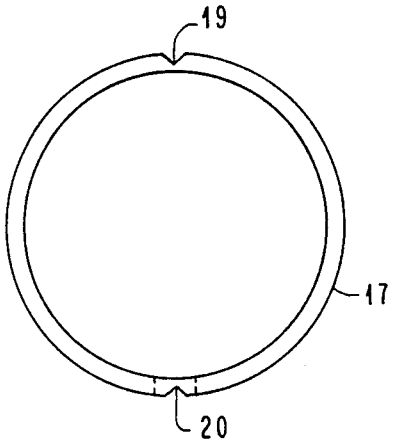
FIG. 4 is a top plan view of a break out ring used with the drill bit sub of FIG. 1.

A break out ring 17 (see FIG. 2) is removably mounted on the lower portion 15 (see FIG. 1) of the drill bit sub 10 with its upper end 17' (see FIG. 2) abutting a shoulder 18 (see FIG. 1) of the drill bit sub 10 at the junction of the lower portion 15 and the upper portion 16. As shown in FIG. 4, the break out ring 17 has a first weakened portion 19 formed therein and a second weakened portion 20 formed diametrically opposite to the first weakened portion 19.

Figure 2:
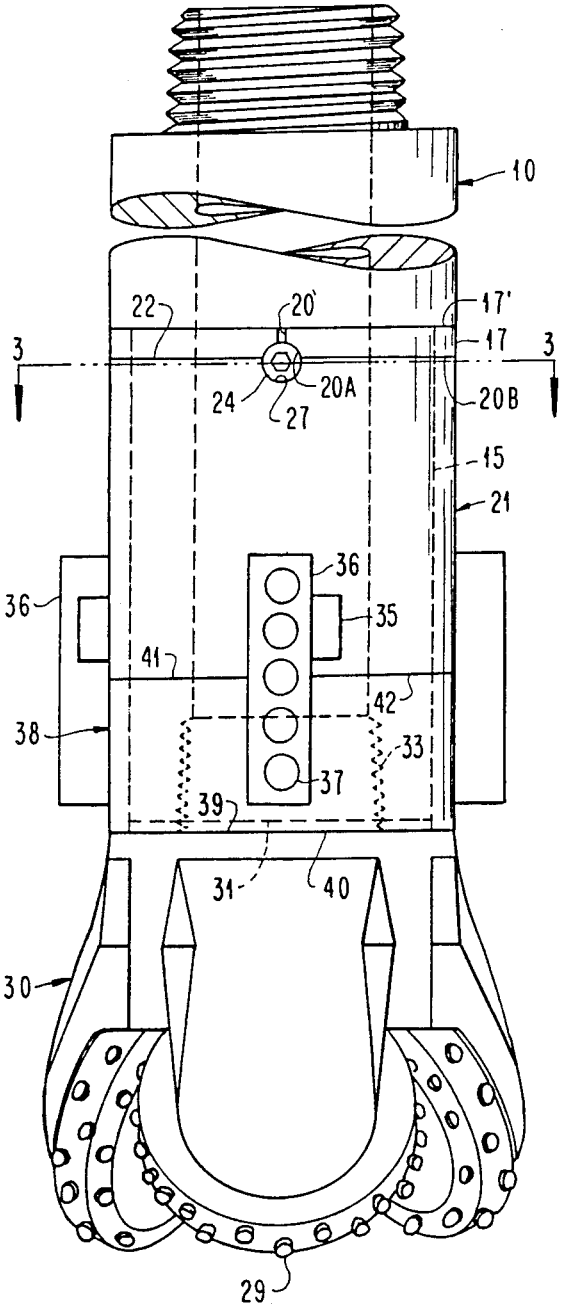
FIG. 2 is an elevational view of the drill bit sub of FIG. 1 with a break out ring, a protective sleeve, a wear strip support, and a drill bit mounted thereon.

As shown in FIG. 2, the second weakened portion 20 does not extend for the depth of the break out ring 17 because of a semi-circular recess 20A formed in bottom surface 20B of the break out ring 17. With the break out ring 17 having a thickness of $\frac{1}{4}''$, each of the weakened portions 19 (see FIG. 4) and 20 has a thickness of $\frac{1}{8}''$.

It should be understood that the semi-circular recess 20A (see FIG. 2) can be disposed other than at the weakened portion 20 or the weakened portion 19 (see FIG. 4). This would result in the weakened portion 20 extending for the depth of the break out ring 17.

Figure 3:
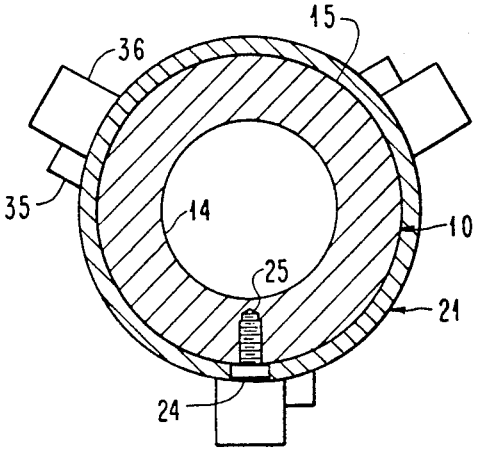
FIG. 3 is a sectional view of the drill bit sub and the protective sleeve and taken along line 3—3 of FIG. 2.

A protective sleeve 21 (see FIG. 2), which is a hollow cylindrical metal tube having a thickness of about $\frac{1}{4}''$, is removably mounted on the lower portion 15 (see FIG. 1) of the drill bit sub 10 with its upper surface 22 (see FIG. 2) abutting the bottom surface 20B of the break out ring 17. The break out ring 17 and the protective sleeve 21 are releasably secured or attached to the lower portion 15 (see FIG. 1) of the drill bit sub 10 through an Allen head cap screw 24 (see FIG. 3) extending into a threaded hole 25 in the lower portion 15 (see FIG. 1) of the drill bit sub 10.

The upper surface 22 (see FIG. 2) of the protective sleeve 21 has a semi-circular recess 27 to receive one half of the head of the Allen head cap screw 24. The semi-circular recess 20A in the break out ring 17 receives the other half of the head of the Allen head cap screw 24.

The semi-circular recess 27 is precisely oriented in accordance with the location of cutters 29 on a drill bit 30, which is attached to bottom end 31 (see FIG. 1) of the drill bit sub 10 through the drill bit sub 10 having a female threaded receptacle 32 to receive a threaded protruding male end 33 (see FIG. 2) of the drill bit 30. The semi-circular recess 27 must be located so that each driving lug 35 on the outer surface of the protective sleeve 21 engages a corresponding wear strip 36, which preferably has a plurality of tungsten carbide inserts 37 in its outer surface, on a wear strip support 38, which is a hollow metal tube removably mounted on the lower portion 15 of the drill bit sub 10 below the protective sleeve 21 to dispose each of the wear strips 36 in alignment with the maximum outer protrusion of one of the cutters 29 on the drill bit 30. Since there are three of the cutters 29 on the drill bit 30, there are three of the wear strips 36 and three of the driving lugs 35.

Since one of the driving lugs 35 has a specific angular relation in a circumferential direction with respect to the semi-circular recess 27 in the protective sleeve 21 and the maximum outer protrusion of each of the cutters 29 of the drill bit 30 can be ascertained when the drill bit 30 is mounted on the drill bit sub 10, the attaching hole 25 (see FIG. 1) in the lower portion 15 of the drill bit sub 10 can be precisely located to constitute a predetermined position. Then, all of the protective sleeves 21 (see FIG. 2) and the wear strip supports 38 used with the drill bit 30 or any substitute drill bit can be precisely positioned on the drill bit sub 10.

It should be understood that the wear strip support 38 extends slightly beyond the bottom end 31 of the lower portion 15 of the drill bit sub 10. This insures that the drill bit 30 has its upper surface 39 engage bottom end 40 of the wear strip support 38 and hold upper end 41 of the wear strip support 38 against bottom end 42 of the protective sleeve 21. For example, the lower portion 15 (see FIG. 1) of the drill bit sub 10 extends for 8", the break out ring 17 (see FIG. 2) extends for ½", the protective sleeve 21 extends for 5¼", and the wear strip support 38 extends for 2½". Therefore, ¼" of the wear strip support 38 would extend beyond the bottom end 31 of the drill bit sub 10.

Each of the driving lugs 35 could be 1" long, ½" wide, and ½" thick, for example, and have its bottom end ¼" from the bottom end 42 of the protective sleeve 21. Each of the wear strips 36 could be 4" long, 1" wide, and 1" thick, for example, and extend 2" beyond the upper end 41 of the wear strip support 38. The thickness of each of the wear strips 36 depends upon the difference in the diameters between the drill bit sub 10 and the drill bit 30.

While each of the wear strips 36 extends above the wear strip support 38 for engagement by one of the driving lugs 35 on the protective sleeve 21, it should be understood that each of the driving lugs 35 could extend downwardly beyond the bottom end 42 of the protective sleeve 21, if desired, so that the wear strips 36 would not have to extend above the upper end 41 of the wear strip support 38. It is only necessary that there be positive engagement between each of the driving lugs 35 and a corresponding one of the wear strips 36 to cause the wear strip support 38 to rotate with the drill bit sub 10.

The break out ring 17 can be easily removed from the lower portion 15 (see FIG. 1) of the drill bit sub 10 when it is desired to remove the drill bit 30 (see FIG. 2) from the drill bit sub 10. After removal of the Allen head cap screw 24, a tool such as a chisel, for example, is inserted into the second weakened portion 20 of the break out ring 17 to fracture the second weakened portion 20. Then, insertion of the tool against one of the edges of the fractured second weakened portion 20 causes fracturing of the first weakened portion 19 (see FIG. 4) whereby each of the two portions of the break out ring 17 may be easily removed. This enables the protective sleeve 21 (see FIG. 2) and the wear strip support 38 to be raised to allow easy turning of the drill bit 30 to unthread it from the drill bit sub 10.

A break out ring 43 (see FIG. 5) may be utilized with the drill bit sub 10 (see FIG. 2) and the protective sleeve 21 instead of the break out ring 17. The break out ring 43 (see FIG. 5) is removably mounted on the lower portion 15 (see FIG. 1) of the drill bit sub 10 with its upper end 44 (see FIG. 6) abutting the shoulder 18 of the drill bit sub 10.

Figure 5:
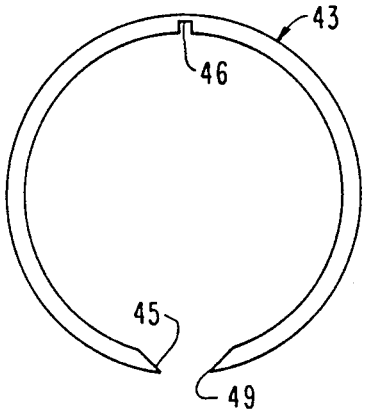
FIG. 5 is a top plan view of another form of a break out ring used with the drill bit sub of FIG. 1.

As shown in FIG. 5, the break out ring 43 has a slot 45 formed therein and preferably extending 1¼" with its edges formed at an angle of 45°. The break out ring 43 has a weakened portion 46 formed diametrically opposite to the slot 45. The weakened portion 46 preferably has a thickness of 1/64" and a width of ⅛".

Because the break out ring 43 extends when the slot 45 is formed therein, it is necessary to bend the break out ring 43 back into shape. Thus, the manufacturing process of the break out ring 17 (see FIG. 4) is quicker and less expensive than that for forming the break out ring 43 (see FIG. 6).

Figure 6:
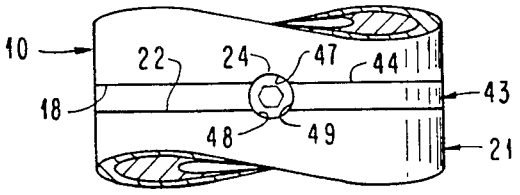
FIG. 6 is an elevational view of the break out ring of FIG. 5, a portion of the drill bit sub of FIG. 2, and a portion of the protective sleeve of FIG. 2.

When the break out ring 43 is used instead of the break our ring 17 (see FIG. 2), the drill bit sub 10 (see FIG. 6) has an arcuate recess 47 in the shoulder 18 to receive a portion of the head of the Allen head cap screw 24. The upper surface 22 of the protective sleeve 21 has a similar arcuate recess 48, which is smaller than the semi-circular recess 27 (see FIG. 2) to receive another portion of the head of the Allen head cap screw 24 (see FIG. 6). The break out ring 43 (see FIG. 5) has its edges 49 of the slot 45 curved, as shown in FIG. 6, to embrace portions of the head of the Allen head cap screw 24.

The break out ring 43 (see FIG. 5) can be easily removed from the lower portion 15 (see FIG. 1) of the drill bit sub 10 when it is desired to unthread the drill bit 30 (see FIG. 2) from the drill bit sub 10. After removal of the Allen head cap screw 24, a tool such as a chisel, for example, is inserted inside one of the edges 49 (see FIG. 5) of the break out ring 43 and force is applied to cause the weakened portion 46 to fracture so that one half of the break out ring 43 can be removed. The tool is then inserted inside the other of the edges 49 of the break out ring 43 to remove it from the lower portion 15 (see FIG. 1) of the drill bit sub 10. Instead of inserting the tool at the edges 49 (see FIG. 5) of the break out ring 43, the tool can be driven against the break out ring 43 at the weakened portion 46 to cause the weakened portion 46 to fracture.

After the break out ring 43 is removed, the protective sleeve 21 (see FIG. 2) and the wear strip support 38 can be raised. This enables manual turning of the drill bit 30 since it is not engaging the bottom end 40 of the wear strip support 38.

Figure 7:
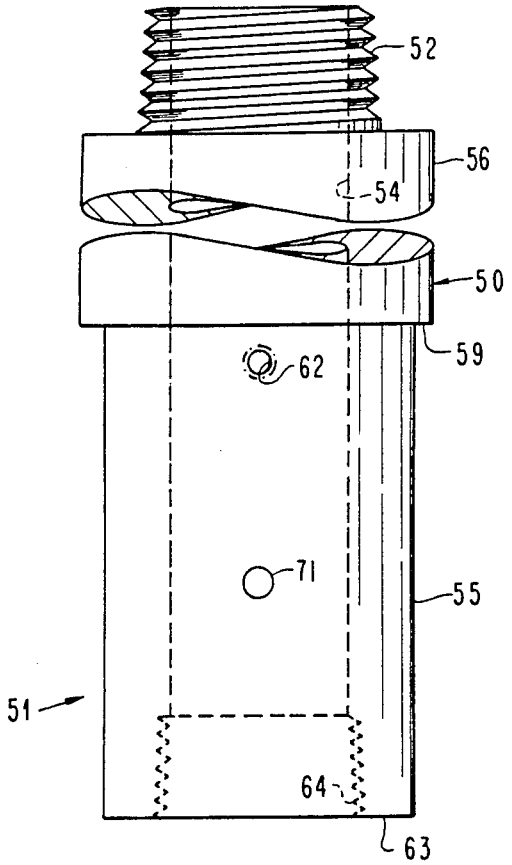
FIG. 7 is an elevational view of another form of drill bit sub of the present invention in which a break out ring is not used.

Referring to FIG. 7, there is shown a drill bit sub 50 of a drilling tool 51 for drilling a hole in the ground. The drill bit sub 50 is connected to a lowermost drill section (not shown) of the drilling tool 51 through having its upper threaded end 52 threaded into a threaded receptacle (not shown) in the lowermost drill section (not shown) of the drilling tool 51.

The drilling tool 51 has driving means on the ground at the upper end of the drilling tool 51 for rotating the drill bit sub 50 in the well-known manner. Pressurized air is supplied from a pressurized air source (not shown) on the ground through communicating longitudinal or axial passages in the drilling sections of the drilling tool 11 to a longitudinal or axial passage 54 extending through the drill bit sub 50.

The drill bit sub 50 has a lower portion 55 formed with a reduced diameter. The diameter of the lower portion 55 is ½" smaller than the diameter of an upper portion 56 of the drill bit sub 50. For example, if the upper portion 56 has a diameter of 5½", then the lower portion 55 has a diameter of 5".

Figure 8:
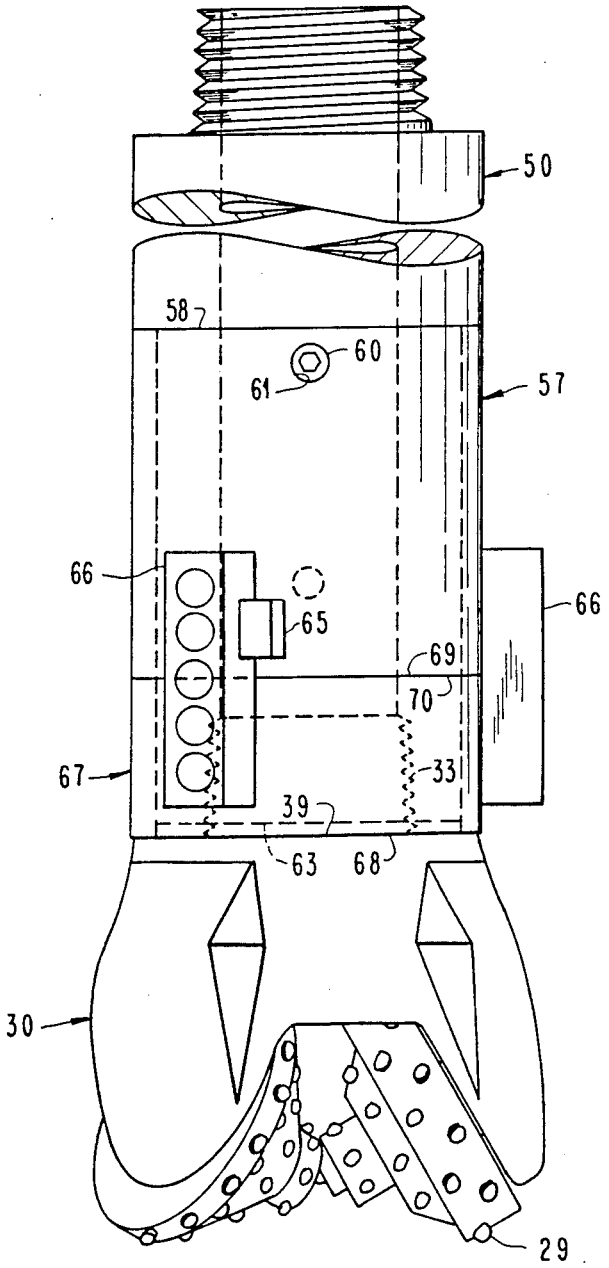
FIG. 8 is an elevational view of the drill bit sub of FIG. 7 with a protective sleeve, a wear strip support, and a drill bit mounted thereon.

A protective sleeve 57 (see FIG. 8), which is a hollow cylindrical metal tube having a thickness of about ¼", is removably mounted on the lower portion 55 (see FIG. 7) of the drill bit sub 50 with its upper surface 58 (see FIG. 8) abutting a shoulder 59 (see FIG. 7) at the junction of the lower portion 55 and the upper portion 56 of the drill bit sub 50.

The protective sleeve 57 (see FIG. 8) is releasably secured or attached to the lower portion 55 (see FIG. 7) of the drill bit sub 50 through having Allen head screws 60 (see FIG. 8) extending through a pair of diametrically disposed holes 61 (one shown in FIG. 8) in the protective sleeve 57 into a pair of diametrically disposed threaded holes 62 (one shown in FIG. 7) in the lower portion 55 of the drill bit sub 50.

Each of the threaded holes 62 is precisely oriented in accordance with the location of the cutters 29 (see FIG. 8) on the drill bit 30. The drill bit 30 is attached to bottom end 63 (see FIG. 7) of the drill bit sub 50 through the drill bit sub 50 having a female threaded receptacle 64 to receive the threaded protruding male end 33 (see FIG. 8) of the drill bit 30.

The threaded holes 62 (see FIG. 7) must be located so that each driving lug 65 (see FIG. 8) on the outer surface of the protective sleeve 57 engages a corresponding wear strip 66 on a wear strip support 67, which is removably mounted on the lower portion 55 (see FIG. 7) of the drill bit sub 50 below the protective sleeve 57 (see FIG. 8), to dispose each of the wear strips 66, which preferably are the same as the wear strips 36 (see FIG. 2), in alignment with the maximum outer protrusion of one of the cutters 29 (see FIG. 8) on the drill bit 30. Since there are three of the cutters 29 on the drill bit 30, there are three of the wear strips 66 and three of the driving lugs 65.

Since one of the driving lugs 65 has a specific angular location with respect to one of the holes 61 in the protective sleeve 57 and the maximum outer protrusion of each of the cutters 29 on the drill bit 30 can be ascertained when the drill bit 30 is mounted on the drill bit sub 50, each of the threaded holes 62 (see FIG. 7) in the lower portion 55 of the drill bit sub 50 can be precisely located to constitute a predetermined position. Then, all of the protective sleeves 57 (see FIG. 8) and the wear strip supports 67 used with the drill bit 30 and any substitute drill bit can be precisely positioned on the drill bit sub 50.

It should be understood that the wear strip support 67 extends slightly beyond the bottom end 63 of the lower portion 55 (see FIG. 5) of the drill bit sub 50. This insures that the upper surface 39 (see FIG. 8) of the drill bit 30 engages bottom end 68 of the wear strip support 67 and holds upper end 69 of the wear strip support 67 against bottom end 70 of the protective sleeve 57. For example, the lower portion 55 (see FIG. 7) of the drill bit sub 50 extends for 7⅞", the protective sleeve 57 (see FIG. 8) extends for 5½" and the wear strip support 67 extends for 2½". Therefore, ⅛" of the wear strip support 67 would extend beyond the bottom end 63 of the drill bit sub 50.

While each of the wear strips 66 extends above the wear strip support 67 for engagement with one of the driving lugs 6 on the protective sleeve 57, it should be understood that each of the driving lugs 65 could extend downwardly beyond the bottom end 70 of the protective sleeve 57 so that the wear strips 66 would not have to extend above the upper end 69 of the wear strip support 67. It is only necessary that there be positive engagement between each of the driving lugs 65 and a corresponding one of the wear strips 66 to cause the wear strip support 67 to rotate with the drill bit sub 50.

While the drill bit sub 50 (see FIG. 7) has been shown and described as having only the two threaded holes 62, it should be understood that there could be more of the threaded holes 62 if desired. However, alignment is still made through the angular relation in a circumferential direction of one of the driving lugs 65 (see FIG. 8) and the adjacent hole 61 in the protective sleeve 57 with respect to one of the cutters 29 on the drill bit 30.

The drill bit sub 50 (see FIG. 7) has a plurality of passages 71 (one shown) formed through the lower reduced portion 55 of the drill bit sub 50 to communicate the exterior of the lower reduced portion 55 of the drill bit sub 50 with the longitudinal or axial passage 54. There are preferably three of the passages 71 equally angularly spaced around the circumference of the lower reduced portion 55 of the drill bit sub 50. Each of the passages 71 is preferably ¼" in diameter.

Figure 9:
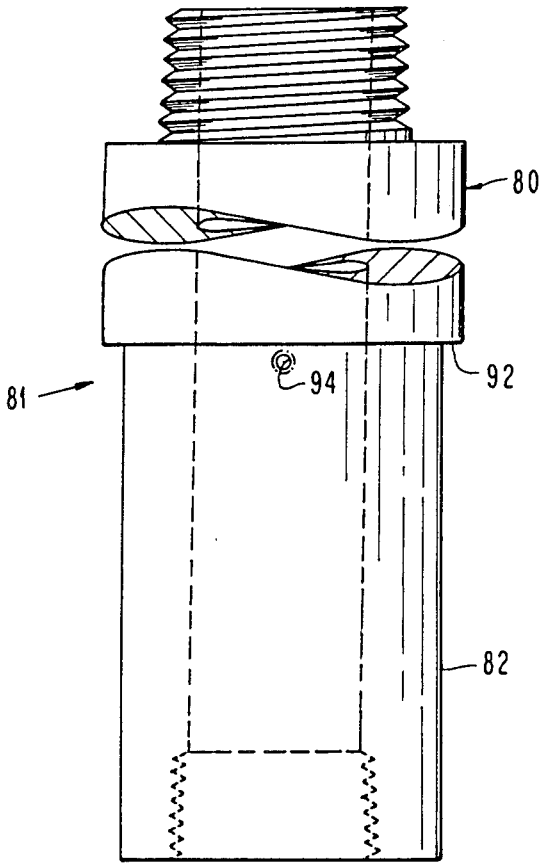
FIG. 9 is an elevational view of another modification of a drill bit sub of the present invention in which a protective sleeve is not used.

The passages 71 enable the compressed air, which is passing through the axial passage 54 in the drill bit sub 50, to keep dust from packing between the drill bit sub 50 and the protective sleeve 57 (see FIG. 8) and the wear strip support 67. This prevention of the build up of dust should aid in easier removal of the elements on the drill bit sub 50. It should be understood that the air passages 71 (see FIG. 7) also may be utilized with the longitudinal passage 14 (see FIG. 1) in the drill bit sub 10 in the same manner Referring to FIG. 9, there is shown a drill bit sub 80 of a drilling tool 81 for drilling a hole in the ground. The drill bit sub 80 is connected to a lowermost drill section (not shown) of the drilling tool 81 in the same manner as the drill bit sub 10 (see FIG. 1). The drill bit sub 80 (see FIG. 9) is rotated by driving means on the ground at the upper end of the drilling tool 81 in the well-known manner. Pressurized air is supplied in the same manner as discussed for the drill bit sub 50 (see FIG. 7).

Figure 10:
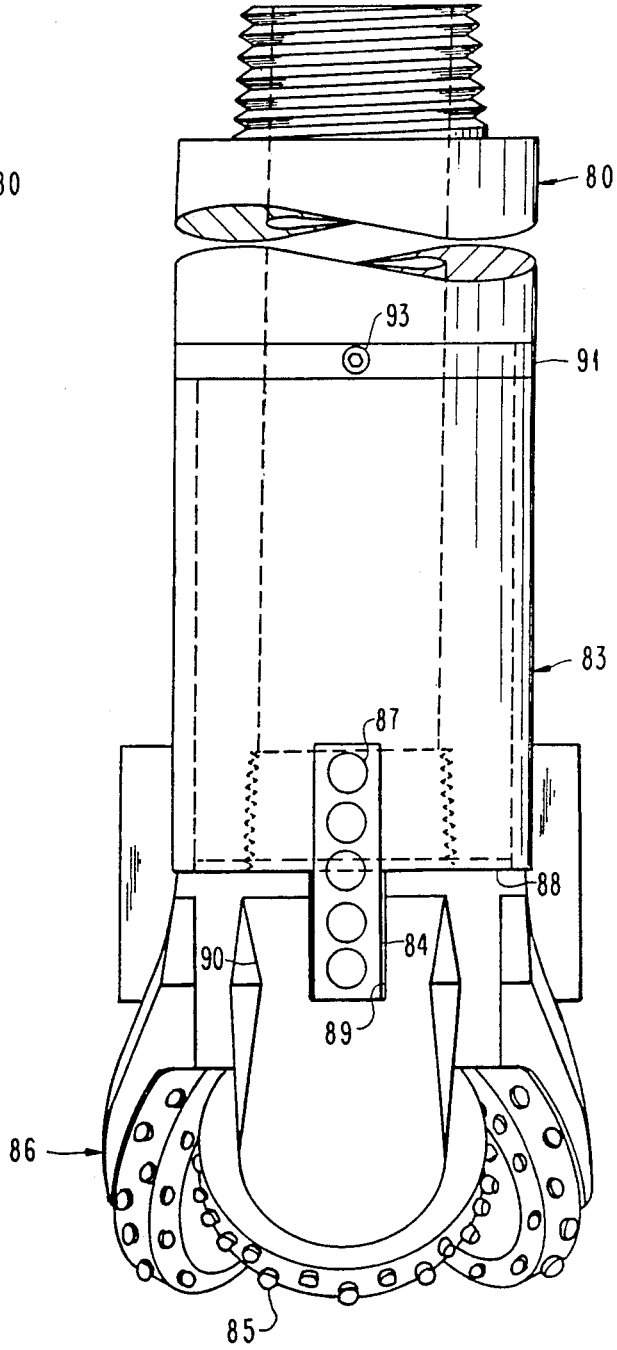
FIG. 10 is an elevational view of the drill bit sub of FIG. 9 with a break out ring, a wear strip support, and a drill bit mounted thereon.

The drill bit sub 80 (see FIG. 9) has a lower portion 82 formed with a reduced diameter in the same manner as previously discussed for the drill bit sub 50 (see FIG. 7). A wear strip support 83 (see FIG. 10) is removably mounted on the lower portion 82 (see FIG. 9) of the drill bit sub 80. The wear strip support 83 (see FIG. 10) has a plurality of equally angularly spaced wear strips 84 welded thereto and equal in number to the number of cutters 85 on a drill bit 86, which is releasably threaded to the bottom of the drill bit sub 80 in the same manner as the drill bit 30 (see FIG. 2) is releasably threaded to the bottom of the drill bit sub 10.

Each of the wear strips 84 (see FIG. 10) extends for a total of 4" and is 1" wide and 1" thick. Each of the three wear strips 84 preferably has a plurality of tungsten carbide inserts 87 in its outer surface and extends downwardly 2", for example, beyond bottom surface 88 of the wear strip support 83. The portion of each of the wear strips 84 extending beyond the bottom surface 88 of the wear strip support 83 is disposed in a slot 89 in a shank 90, which is $1\frac{1}{8}''$ wide, 2" in length, and $\frac{1}{2}''$ deep, of the drill bit 86. Therefore, when the drill bit 86 rotates with the drill bit sub 80, the wear strip support 83 rotates therewith because of the disposition of the protruding portion of each of the wear strips 84 in one of the slots 89 in one of the three shanks 90 of the drill bit 86.

It is preferred that a break out ring 91, which may be similar to the break out ring 17 (see FIG. 4) or the break out ring 43 (see FIG. 5), be disposed above the wear strip support 83 (see FIG. 10) and bear against a shoulder 92 (see FIG. 9) of the drill bit sub 80. The break out ring 91 (see FIG. 10) preferably has two diametrically disposed weakened portions in the same manner as the break out ring 17 (see FIG. 4). An Allen head cap screw 93 (see FIG. 10) secures the break out ring 91 to the lower portion 82 (see FIG. 9) of the drill bit sub 80 through the Allen head cap screw 93 (see FIG. 10) extending into a threaded hole 94 (see FIG. 9) in the lower portion 82 of the drill bit sub 80. If desired, the Allen head cap screw 93 (see FIG. 10) can be inserted through a hole in the break out ring 91 other than at one of the weakened portions.

While the break out ring 91 extends for only $\frac{1}{2}''$ and each of the wear strips 84 has a width of 2" and a length of 4" so that each of the wear strips 84 has a 2" portion extending beyond the bottom surface 88 of the wear strip support 83, the removal of the break out ring 91 permits lifting of the wear strip support 83 to prevent a tight engagement of the bottom surface 88 of the wear strip support 83 with the drill bit 86. This permits easy removal of the drill bit 86 from the drill bit sub 80.

An advantage of this invention is that it reduces the cost for replacing wear strips of a drilling tool. Another advantage of this invention is that it extends the life of a drill bit sub through protecting it against metal failure by particles removed by the drill bit cutters striking the drill bit sub. A further advantage of this invention is that a wear strip support may be easily and quickly replaced at the same time that a drill bit is replaced.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

I claim:

1. A drilling tool for drilling a hole in the ground including:

a drill bit sub having a lower reduced portion of substantially constant diameter;

removably mounted means removably mounted on said lower reduced portion of said drill bit sub, said removably mounted means having a substantially constant inner diameter;

said removably mounted means having a plurality of wear strips thereon;

a drill bit releasably attached to the bottom of said drill bit sub for rotation therewith, said drill bit being adjacent said removably mounted means and engaging the bottom of said removably mounted means;

said drill bit having a plurality of cutters;

causing means for causing rotation of said removably mounted means with said drill bit sub and said drill bit;

said wear strips being equal in number to said cutters on said drill bit;

and each of said wear trips on said removably mounted means being aligned with one of said cutters on said drill but at least during rotation of said drill bit sub.

2. The drilling tool according to claim 1 in which:

said removably mounted means includes:

support means having said wear strips mounted thereon;

and drive transmitting means, separate from said support means, mounted above said support means;

and said causing means includes:

said drive transmitting means;

securing means for securing said drive transmitting means to said lower reduced portion of said drill bit sub for rotation therewith;

and said drive transmitting means having cooperating means for cooperating with said support means to cause rotation of said support means with said drill bit sub.

3. The drilling tool according to claim 1 in which said removably mounted means extends a slight distance beyond said lower reduced portion of said drill bit sub.

4. The drilling tool according to claim 1 in which:

said drill bit sub has an axial air passage extending therethrough to supply compressed air to said drill bit;

and said lower reduced portion of said drill bit sub has a plurality of air passages extending radially from its outer surface of substantially constant diameter to said axial air passage extending through said drill bit sub.

5. The drilling tool according to claim 1 in which said removably mounted means includes:

at least one hollow cylindrical tube;

said one hollow cylindrical tube having said wear strips mounted thereon;

and said one hollow cylindrical tube having a substantially constant outer diameter except for said wear strips.

6. The drilling tool according to claim 5 in which:

said drill bit sub includes a portion of a substantially constant diameter above said lower reduced portion and larger than said lower reduced portion;

and the substantially constant outer diameter of said one hollow cylindrical tube is the same as the substantially constant diameter of said portion of said drill sub above said lower reduced portion.

7. The drilling tool according to claim 1 in which:

said drill bit sub includes a portion of a substantially constant outer diameter above said lower reduced portion and larger than said lower reduced portion;

and said removably mounted means has a substantially constant outer diameter that is the same as the substantially constant outer diameter of said portion of said drill bit sub above said lower reduced portion.

8. A drilling tool for drilling a hole in the ground including:

a drill bit sub having a lower reduced portion;

removably mounted means removably mounted on said lower reduced portion of said drill bit sub;

said removably mounted means having a plurality of wear strips thereon;

a drill bit releasably attached to the bottom of said drill bit sub for rotation therewith, said drill bit being adjacent said removably mounted means and engaging the bottom of said removably mounted means;

said drill bit having a plurality of cutters;

causing means for causing rotation of said removably mounted means with said drill bit sub and said drill bit;

each of said wear strips on said removably mounted means being aligned with one of said cutters on said drill bit at least during rotation of said drill bit sub;

said removably mounted means including: support means having said wear strips mounted thereon; and drive transmitting means mounted above said support means;

said causing means including:

said drive transmitting means;

securing means for securing said drive transmitting means to said lower reduced portion of said drill bit sub for rotation therewith;

and said drive transmitting means having cooperating means for cooperating with said support means to cause rotation of said support means with said drill bit sub;

said drill bit sub including:

an upper portion above said lower reduced portion;

and a shoulder at the junction of said upper portion and said lower reduced portion;

said drive transmitting means including:

a ring having at least one weakened portion capable of being fractured;

said ring being mounted on said lower reduced portion of said drill bit sub in engagement with said shoulder of said drill bit sub;

and a hollow cylindrical tube mounted on said lower reduced portion of said drill bit sub beneath said ring and in contact therewith, said hollow cylindrical tube being disposed above said support means and in contact therewith, said hollow cylindrical tube having said cooperating means of said drive transmitting means;

and said securing means of said causing means including releasably securing means for releasably securing said ring and said hollow cylindrical tube to said lower reduced portion of said drill bit sub for rotation therewith.

9. The drilling tool according to claim 8 in which said cooperating means of said drive transmitting means includes a plurality of driving means on the outer surface of said hollow cylindrical tube at predetermined positions, each of said driving means engaging one of said wear strips on said support means to cause rotation of said support means with said drill bit sub.

10. The drilling tool according to claim 9 in which:

said drill bit sub has an axial air passage extending therethrough to supply compressed air to said drill bit;

and said lower reduced portion of said drill bit sub has a plurality of air passages extending from its outer surface to said axial air passage extending through said drill bit sub.

11. A drilling tool for drilling a hole in the ground including:

a drill bit sub having a lower reduced portion;

removably mounted means removably mounted on said lower reduced portion of said drill bit sub;

said removably mounted means having a plurality of wear strips thereon;

a drill bit releasably attached to the bottom of said drill bit sub for rotation therewith, said drill bit being adjacent said removably mounted means and engaging the bottom of said removably mounted means;

said drill bit having a plurality of cutters;

causing means for causing rotation of said removably mounted means with said drill bit sub and said drill bit;

each of said wear strips on said removably mounted means being aligned with one of said cutters on said drill bit at least during rotation of said drill bit sub;

said removably mounted means including: support means having said wear strips mounted thereon; and drive transmitting means mounted above said support means;

said causing means including:

said drive transmitting means;

securing means for securing said drive transmitting means to said lower reduced portion of said drill bit sub for rotation therewith;

and said drive transmitting means having cooperating means for cooperating said said support means to cause rotation of said support means with said drill bit sub;

said drive transmitting means including a hollow cylindrical tube mounted on said lower reduced portion of said drill bit sub at a predetermined position and above said support means and in contact therewith;

said securing means of said causing means including releasably securing means for releasably securing said hollow cylindrical tube to said lower reduced portion of said drill bit sub for rotation therewith;

and said cooperating means of said drive transmitting means including a plurality of driving means on the outer surface of said hollow cylindrical tube at predetermined positions, each of said driving means engaging one of said wear strips on said support means to cause rotation of said support means with said drill bit sub.

12. The drilling tool according to claim 11 in which:

said drill bit sub has an axial air passage extending therethrough to supply compressed air to said drill bit;

and said lower reduced portion of said drill bit sub has a plurality of air passages extending from its outer surface to said axial air passage extending through said drill bit sub.

13. The drilling tool according to claim 11 in which each of said wear strips extends upwardly beyond said support means to overlie a portion of said hollow cylindrical tube for engagement by said driving means.

14. A drilling tool for drilling a hole in the ground including:

a drill bit sub having a lower reduced portion;

removably mounted means removably mounted on said lower reduced portion of said drill bit sub;

said removably mounted means having a plurality of wear strips thereon;

a drill bit releasably attached to the bottom of said drill bit sub for rotation therewith, said drill bit being adjacent said removably mounted means and engaging the bottom of said removably mounted means;

said drill bit having a plurality of cutters;

causing means for causing rotation of said removably mounted means with said drill bit sub and said drill bit;

each of said wear strips on asid removably mounted means being aligned with one of said cutters on said drill bit at least during rotation of said drill bit sub;

and said causing means including cooperating means on said drill bit for cooperating with said removably mounted means to cause rotation of said removably mounted means with said drill bit and said drill bit sub.

15. The drilling tool according to claim 14 in which:

each of said wear strips on said removably mounted means extends below said removably mounted means;

and said cooperating means includes a plurality of engaging means for engaging each of said wear strips on said removably mounted means, said engaging means being equal in number to said wear strips.

16. The drilling tool according to claim 15 in which:

said drill bit sub includes:

an upper portion above said lower reduced portion;

and a shoulder at the junction of said upper portion and said lower reduced portion;

and said removably mounted means includes:

a ring having at least one weakened portion capable of being fractured;

said ring being mounted on said lower reduced portion of said drill bit sub in engagement with said shoulder of said drill bit sub;

and support means having said wear strips mounted thereon, said support means being in engagement with the bottom of said ring.

17. A protective sleeve for use with a drill bit sub of a drilling tool having a drill bit with cutters for drilling a hole in the ground and for transmitting rotation of the drill bit sub to a wear strip support having a plurality of equally angularly spaced wear strips extending from its outer surface, said protective sleeve including:

a hollow cylindrical tube;

said hollow cylindrical tube having a plurality of equally angularly spaced engaging means thereon, each of said engaging means engaging one of the wear strips on the wear strip support;

and positioning means for positioning said hollow cylindrical tube on the drill bit sub at a predetermined position so that each of the wear strips on the wear strip support engaged by one of said engaging means will be aligned with the maximum outer protrusion of one of a plurality of cutters on the drill bit releasably attached to the bottom end of the drill bit sub when each of said engaging means engages one of the wear strips.

18. The protective sleeve according to claim 17 in which said positioning means includes enabling means for enabling said hollow cylindrical tube to be releasably connected to the drill bit sub.

* * * * *

UNITED STATES PATENT AND TRADEMARK OFFICE

CERTIFICATE OF CORRECTION

PATENT NO. : 5,058,689

DATED : October 22, 1991

INVENTOR(S) : Stephen M. Collinsworth

It is certified that error appears in the above-identified patent and that said Letters Patent is hereby corrected as shown below:

Column 2, line 67, "us" should read --- use ---.
Column 4, line 16, "drill" should read --- drilling ---.
Column 8, line 5, "6" should read --- 65 ---.
Column 10, line 3, "trips" should read --- strips ---.
Column 10, line 5, "but" should read --- bit ---.
Column 10, line 50, after "drill" insert --- bit ---.
Column 11, lines 11-14, should read as follows:

--- said removably mounted means including:
support means having said wear strips mounted thereon;
and drive transmitting means mounted above said support means; ---.

UNITED STATES PATENT AND TRADEMARK OFFICE

CERTIFICATE OF CORRECTION

PATENT NO. : 5,058,689

DATED : October 22, 1991

INVENTOR(S) : Stephen M. Collinsworth

It is certified that error appears in the above-identified patent and that said Letters Patent is hereby corrected as shown below:

Column 11, lines 28-46 should read as follows:

--- said drive transmitting means including:
a ring having at least one weakened portion capable of being fractured;
said ring being mounted on said lower reduced portion of said drill bit sub in engagement with said shoulder of said drill bit sub;
and a hollow cylindrical tube mounted on said lower reduced portion of said drill bit sub beneath said ring and in contact wherewith, said hollow cylindrical tube being disposed above said support means and in contact therewith, said hollow cylindrical tube having said cooperating means of said drive transmitting means;
and said securing means of said causing means including releasably securing means for releasably securing said ring and said hollow cylindrical tube to said lower reduced portion of said drill bit sub for rotation therewith.---.

UNITED STATES PATENT AND TRADEMARK OFFICE

CERTIFICATE OF CORRECTION

PATENT NO. : 5,058,689

DATED : October 22, 1991

INVENTOR(S) : Stephen M. Collinsworth

It is certified that error appears in the above-identified patent and that said Letters Patent is hereby corrected as shown below:

Column 12, lines 13-16, should read as follows:

--- said removably mounted means including:
support means having said wear strips mounted thereon;
and drive transmitting means mounted above said support means; ---.

Column 12, line 24, cancel the first occurrence of "said" and substitute --- with ---.

Column 13, line 4, "asid" should read --- said ---.

Signed and Sealed this

Second Day of February, 1993

*Attest:*

STEPHEN G. KUNIN

*Attesting Officer*

*Acting Commissioner of Patents and Trademarks*